US006634608B2

(12) United States Patent
Jacobowitz

(10) Patent No.: US 6,634,608 B2
(45) Date of Patent: Oct. 21, 2003

(54) WALKING AID STABILIZING APPARATUS

(76) Inventor: John Jacobowitz, 31 Charming La., Williamsville, NY (US) 14221

( * ) Notice: Subject to any disclaimer, the term of this patent is extended or adjusted under 35 U.S.C. 154(b) by 0 days.

(21) Appl. No.: 10/103,305

(22) Filed: Mar. 21, 2002

(65) Prior Publication Data

US 2003/0178054 A1 Sep. 25, 2003

(51) Int. Cl.[7] ..... A47B 96/06
(52) U.S. Cl. ..... 248/230.7; 135/65; 135/77
(58) Field of Search ..... 135/77, 78, 80, 135/65; 248/309.1, 316.7, 230.7

(56) References Cited

U.S. PATENT DOCUMENTS 3,163,437 A * 12/1964 Phillipson ..... 280/824
3,170,475 A * 2/1965 Forbes ..... 135/80
3,177,884 A 4/1965 Thro
4,098,283 A 7/1978 Tritle
4,411,284 A 10/1983 Opitz
4,434,808 A 3/1984 Burak
4,899,771 A 2/1990 Wilkinson
5,307,828 A 5/1994 Gardner
5,385,163 A * 1/1995 Fairchild ..... 135/65
5,390,687 A * 2/1995 Tsai ..... 135/65
5,433,234 A 7/1995 Lapere
5,713,382 A 2/1998 Midcap
5,794,638 A * 8/1998 Richey et al. ..... 135/65
6,003,533 A 12/1999 Midcap
6,164,306 A 12/2000 Townsend
6,527,001 B1 * 3/2003 Saldan et al. ..... 135/82

* cited by examiner

*Primary Examiner*—Ramon O. Ramirez
(74) *Attorney, Agent, or Firm*—John F. Letchford; Klehr, Harrison, Harvey, Branzburg & Ellers LLP

(57) ABSTRACT

A walking aid stabilizing device that is useful for stabilizing walking aids when a user in travels over compressible and uneven areas and substances. The stabilizing device includes at least one entirely exteriorly mountable fastener for enabling the apparatus to be quickly and easily attached to and detached from the exterior of solid or hollow walking aids, such as canes, crutches, walkers, or the like, having standard and non-standard diameters or circumferential shapes. The device further includes a ground engagement member that may be quickly and easily disposed into an operative first operative ground engaging position and a second inoperative position. The ground engagement member has perforated areas to permit the passage of snow or wet sand, mud or earth which could otherwise clog the ground engagement member in use.

17 Claims, 2 Drawing Sheets

WALKING AID STABILIZING APPARATUS

FIELD OF THE INVENTION

The present invention relates in general to walking assistance devices and in particular to apparatus for stabilizing walking aids when a user travels over compressible and uneven areas and substances.

BACKGROUND OF THE INVENTION

Canes, crutches, walkers and other walking aids are commonly used to assist a person in walking. When using such a device, the person relies upon the device to stabilize or balance himself as he travels in a forward direction using his natural legs to achieve forward movement.

Because the ground contacting portion(s) thereof provide only small, generally flat ground engaging surface areas, persons using conventional walking aids often experience difficulty due to the substantial amount of manual dexterity and balance that are required to manipulate the devices. These problems are exacerbated when one uses the walking aid to navigate treacherous surfaces. For slippery surfaces such as ice, it has been proposed to provide the bottom of the walking assistance device with spiked or pointed ground engaging means that, because of the very small surface areas at their tips, tend to penetrate the ice for enhanced traction. Examples of such equipment is described in U.S. Pat. Nos. 3,177,884; 4,434,808 and 5,433,234.

However, spiked ground engagement means are of limited use in promoting the stability of walking aids in snow, sand and other compressible or uneven areas and substances. For conventional canes, crutches and other walking assistance devices, such terrain can be as difficult to traverse for the physically impaired as icy surfaces. Standard walking aids and walking aids with spiked ground engagement means can sink deeply into such surfaces which can destabilize even a person prepared for the potential danger.

Others have proposed apparatus that serve to enlarge the surface contacting areas of canes, crutches and the like for use on snow, sand and other soft or hazardous surfaces. Examples of such devices are provided in U.S. Pat. Nos. 4,098,283; 4,899,771; 5,307,828; 5,713,382; 6,003,533 and 6,164,306. Among these, however, only the device described in U.S. Pat. No. 4,098,283 provides openings to permit the passage of snow or wet sand, mud or earth which could otherwise clog the device in use. Nevertheless, the device disclosed in U.S. Pat. No. 4,098,283 requires modification of and permanent attachment to the bottom of the resilient rubber or plastic cap that is typically located at the bottom of a cane or crutch. Thus, to use the device, the user must remove the existing walking aid cap and then physically attach the device to the cap (or otherwise acquire such a device preassembled onto a standard cap) and then reinstall the modified cap onto the bottom of the walking aid. When he chooses not to use it, he must remove the modified cap and replace it with another standard walking aid cap. The modified walking aid cap would thus essentially serve as a substitute for the standard cap, whereby the user may choose and attach the desired cap to the walking aid as circumstances dictate. It will be appreciated that replacement of one cap with another can be frustrating and difficult for physically weak or disabled persons that must overcome the significant friction that retains the typical resilient cap on the bottom of a conventional cane or crutch. Moreover, the cap of the apparatus taught by U.S. Pat. No. 4,098,283 has a fixed internal diameter and can only work with canes, crutches or other walking aids having a corresponding outer diameter. If the walking aid is not of standard circumferential dimensions, the cap may be too small or too large to fit the walking aid.

U.S. Pat. No. 4,411,284 proposes a walking aid tip assembly that can be used on both ice and snow. The assembly comprises a central spiked member for assisting the user in traversing ice and an annular flexible foot member surrounding the central spiked member that assists the user in traversing softer surfaces. The flexible member is movable between an operative ground engaging position and an inoperative position. The assembly can only be used with hollow walking aids and requires a latching device located internally of the hollow walking aid to fasten the assembly to the walking aid and to enable the flexible member to be moved between its operative and inoperative positions. The internal latching device can only be removed with difficulty. And, when the assembly is removed from the walking aid, the open bottom of the walking aid is unprotected. In such condition, the hollow walking aid cannot be used without exposing its open bottom end to clogging with dirt or possible damage. In addition, the flexible foot member has no apertures for preventing clogging when the device is used on snow or wet sand, mud or earth.

An advantage exists therefore for a walking aid stabilizing apparatus that is useful for stabilizing walking aids when a user in travels over compressible and uneven areas and substances.

A further advantage exists for a walking aid stabilizing apparatus which may be quickly and easily attached to and detached from the exterior of existing hollow or solid walking aids, such as canes, crutches, walkers, or the like, having standard and non-standard diameters or circumferential shapes.

A further advantage exists for a walking aid stabilizing apparatus including ground engagement means that may be quickly and easily disposed into a first operative ground engaging position and a second inoperative position.

A further advantage exists for a walking aid stabilizing apparatus including ground engagement means having perforated areas to permit the passage of snow or wet sand, mud or earth which could otherwise clog the ground engagement means in use.

SUMMARY OF THE INVENTION

The present invention provides a walking aid stabilizing apparatus that is useful for stabilizing walking aids when a user in travels over compressible and uneven areas and substances. The stabilizing apparatus comprises means for enabling the apparatus to be quickly and easily attached to an detached from the exterior of solid or hollow walking aids, such as canes, crutches, walkers, or the like, having standard and non-standard diameters or circumferential shapes. The apparatus further includes ground engagement means that may be quickly and easily disposed into a first operative ground-engaging position and a second inoperative position, as well as means for disposing the ground engagement means into the first operative position and the second inoperative position. According to a presently preferred embodiment, the ground engagement means has perforated areas to permit the passage of snow or wet sand, mud or earth which could otherwise clog the ground engagement means in use.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

Figure 1:
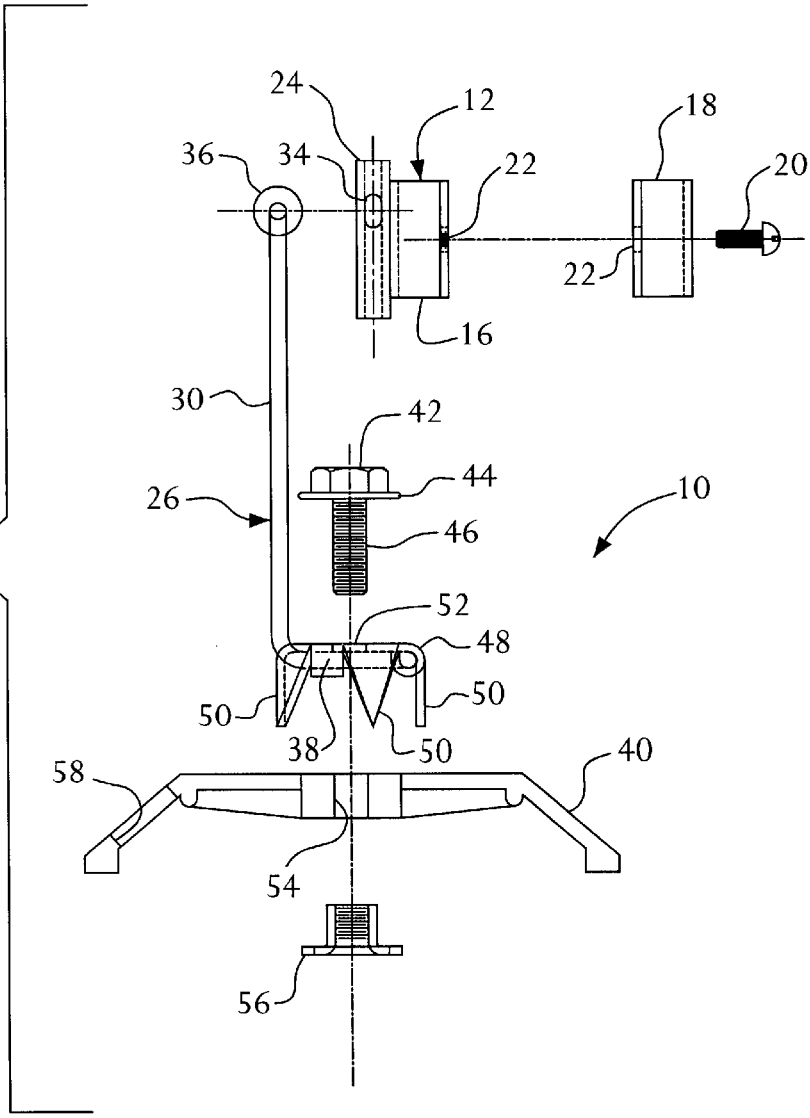
FIG. 1 is an exploded view of a walking aid stabilizing apparatus constructed according to the present invention.

Referring to the drawing figures, wherein like references designate like or similar elements throughout the several views, there is shown a walking aid stabilizing apparatus constructed in accordance with a presently preferred embodiment of the invention and identified generally by reference numeral 10. Apparatus 10 preferably comprises at least one entirely exteriorly mountable fastening means 12 for enabling the apparatus to be quickly and easily attached to an detached from the exterior of a solid or hollow walking aid, such as a cane, crutch, walker, or the like, an example of such a walking aid being partially shown in FIG. 4 and identified generally by reference numeral 14. Fastening means 12 may be any suitable flexible, resilient or rigid device that is capable of firmly yet releasably attaching apparatus 10 to the lower portion of walking aid 14 regardless of whether the walking aid is of a standard or non-standard diameter or circumferential shape. Suitable examples of fastening means 12 may comprise, without limitation, hook and loop type (e.g., VELCRO®) straps, a belt, a substantially C-shaped flexible metal or plastic spring clip or, as illustrated, a rigid metal or plastic two-part clam shell-type clamp.

When constructed as a clam shell-type clamp, fastening means 12 includes a first member 16 and a second member 18 that are adapted to be fitted about the lower end of the shaft (in the case of a cane or crutch) or the leg (in the case of a walker) of walking aid 14. First and second clamp members 16,18 are preferably tightened about the walking aid 14 by a pair of screws, wing bolts or similar threaded fasteners 20 (FIGS. 1 and 4) which pass through aligned bores 22 provided in each of the clamp members 16,18. Preferably the bore 22 of first clamp member 16 has threads adapted to matingly receive the threads of fasteners 20. In the alternative, clamp member 16 may have a nut adhered, welded or otherwise fixedly secured thereto that is adapted to matingly receive the threads of fasteners 20.

Fastening means 12 comprise first means 24 for retaining a ground engagement means support member 26. According to a presently preferred embodiment, first retaining means 24 comprise a rigid bracket having a pair of opposed inwardly directed lips 28 that define opposed pockets. Also according to a presently preferred embodiment, the ground engagement means support member 26 is constructed as a stiff, yet resilient one-piece metal or plastic rod-like member that defines a pair of spaced apart legs 30. As mostly clearly seen in FIGS. 2 and 3, legs 30 are of a size and shape to be received within the pockets of lips 28 of bracket 26. The rod-like ground engagement means support member 26 is bent, molded, or otherwise formed in three dimensions such that, in an unstressed state, legs 30 are spaced apart a distance greater than the distance between the seating surfaces of the pockets defined by lips 28 of bracket 26. Thus, when received within the pockets of lips 28, legs 30 are flexed toward one another by, and are seated firmly against, the seating surfaces of the pockets. With the lips 28 of bracket 26 and the legs 30 of ground engagement support member 26 so constructed and arranged, the ground engagement support member may be securely yet releasably retained in operative and inoperative positions as described below.

At first ends thereof, each of the legs 30 have outwardly and oppositely directed end portions 32 that define actuating means whose function is described hereinafter. End portions 32 project through apertures 34 (FIG. 1) provided in lips 28 of bracket 26 and are preferably provided with enlarged cushion members 36. At the opposite ends thereof, legs 30 are contiguously joined by a loop portion 38 (shown in dashed line in FIG. 3) disposed substantially at a right angle to the legs. Alternatively, loop portion 36 may be a rigid plate, disk or the like having a central opening and fixedly attached to legs 30.

As most clearly illustrated in FIG. 1, walking aid stabilizing apparatus further comprises second retaining means for retaining a ground engagement means 40 onto the loop portion 38 of ground engagement support member 26. According to a presently preferred embodiment, the second retaining means includes a mechanical fastener such as a screw or bolt 42 having an integral, radially enlarged flange 44 and a threaded shaft 46. If desired, a suitably sized washer may be substituted for enlarged flange 44. The second retaining means further desirably comprises a disk-like rigid, preferably metal, retainer member 48 that is adapted to overlie the loop portion 38 of ground engagement support member 26. Preferably, retainer member 48 is provided at its periphery with a plurality of prongs 50 that are adapted to pass through aligned openings provided in ground engagement means 40. Although not shown in the drawing figure for clarity of illustration, prongs 50 are bent inwardly (or outwardly) and upwardly into snug contact with the undersurface of ground engagement means 40 in order to secure the ground engagement means to the retainer member 48. In the alternative, in lieu of prongs 50, retainer member 48 and/or ground engagement means 40 may be provided with other means for retaining ground engagement means 40 such as, for example, permanent or reversible snaps.

Shaft 46 of fastener 42 is sized so as to pass through a central opening 52 in retainer member 48 (FIGS. 1 and 3), loop portion 38 of ground engagement support member 26 and a central opening 54 of ground engagement means 40. An internally threaded nut or similar fastener 56 is tightly threaded onto the shaft 46 of fastener 42 whereby the ground engagement means 40 is brought into firm abutting contact with the loop portion 38 of ground engagement support member 26. Although not shown in the drawings, the relative positions of the fastener 42, fastener 56 and retainer member 48 may be disposed in any combination of ways so long as they effectively function to secure the ground engagement means 40 to the ground engagement support member 26.

It will be understood that the cooperating threaded fasteners 42 and 46 may be replaced by alternative releasable fasteners such as a pin and clip assembly. Furthermore, if a permanent connection is preferred between the ground engagement means 40 and the ground engagement support member 26, releasable fasteners such as fasteners 42 and 56 may be replaced by a permanent connector such as a rivet or the like or the assembly may be united by welding, soldering, brazing, chemical bonding or adhesive bonding.

Figure 3:
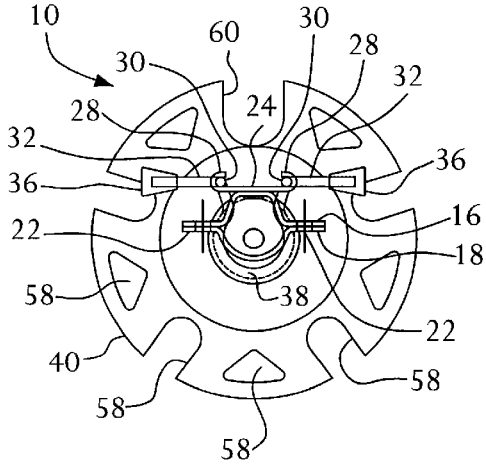
FIG. 3 is top plan view of the apparatus of FIG. 1 in assembled condition.
Figure 4:
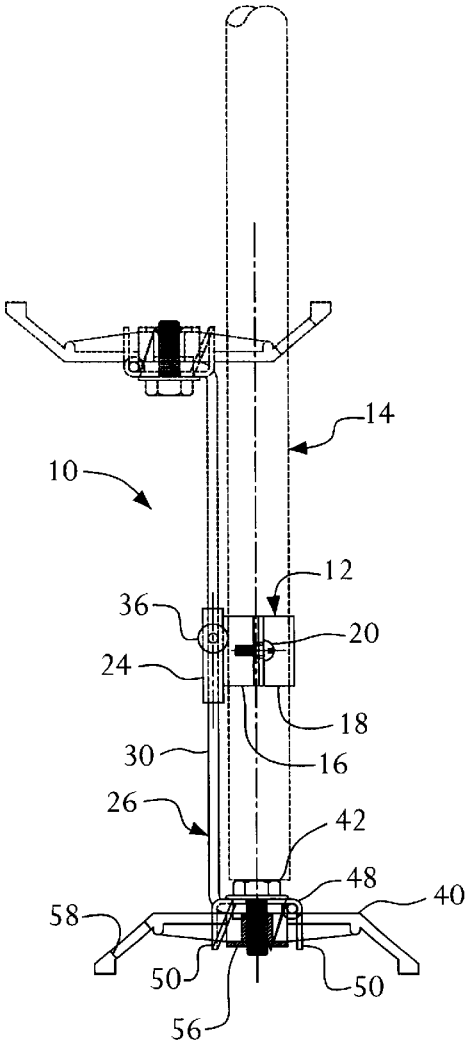
FIG. 4 is a side elevation view of the apparatus of FIG. 1 in assembled condition and attached to a walking aid wherein the ground engagement means of the apparatus is depicted in a first operative ground-engaging position and in a second inoperative-position.
Figure 2:
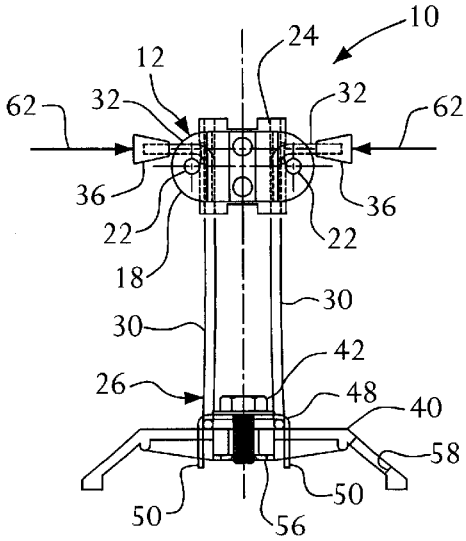
FIG. 2 is a front elevation view of the apparatus of FIG. 1 in assembled condition.

Ground engagement means 40 may assume any configuration so long as it is substantially larger in peripheral area than the ground contacting area of the bottom of the walking aid 14. So constructed, ground engagement means 40 functions to distribute the force exerted by walking aid 14 over a larger surface area which, in turn, resists penetration of the walking aid into soft surfaces such as snow, sand and moist earth, as well as stabilizes the walking aid when a user in travels over such substances and uneven areas. According to a presently preferred construction, as illustrated in FIG. 3, ground engagement means 40 comprises a substantially circular member of about three to about five inches in diameter. However, smaller or larger sizes and different shapes are contemplated to be within the scope of the present invention. Ground engagement means 40 may be substantially planar in elevational profile. Alternatively it may assume a substantially convex or, as depicted in FIGS. 1, 2 and 4, a substantially concave elevational profile. Regardless of peripheral size, shape and elevational profile, however, ground engagement means 40 preferably includes a plurality of perforated areas 58. The purpose of perforated areas 58 is to permit the passage of snow or wet sand, mud or moist earth which could otherwise clog the ground engagement means in use. In addition, ground engagement means 40 may be fabricated from any durable rigid, semi-rigid or flexible material such as, for example, metal, plastic, rubber or the like, so long as it generally retains its shape and designated function when in use.

As mentioned previously, walking aid stabilizing apparatus 10 enables ground engagement means 40 to be disposed into a first operative ground-engaging position (shown in solid line in FIG. 4) and a second inoperative position (shown in dashed line in FIG. 4). When in the first operative ground-engaging position, ground engagement means 40 is positioned beneath the bottom of walking aid 14. When in the second inoperative position, ground engagement means 40 is positioned upwardly from the bottom and alongside of walking aid 14. Additionally, ground engagement means 40 is provided with enlarged peripheral notch 60 (FIG. 3) which is desirably sized large enough to accommodate the circumferential dimensions of walking aids 14 having large and/or irregular circumferential shapes. Peripheral notch 60 is provided to ensure that ground engagement means 40 does not interfere with walking aid 14 and that first retaining means 24 securely retains ground engagement means support member 26 when the ground engagement means is disposed in the second inoperative position.

To dispose ground engagement means 40 from the second inoperative position to the first operative ground-engaging position, a user applies sufficient force against the oppositely directed end portions 32 of legs 30 in the direction of arrows 62 (FIG. 2) to cause the legs to flex inwardly toward one another. The user applies sufficient lateral force to cause the legs 30 of ground engagement means support member 26 to clear the innermost edges of the lips 28 of bracket 24. At this point the user pivots the ground engagement means support member 26 downwardly until legs 30 again clear the innermost edges of the lips 28 of bracket 24. The user then releases the applied lateral force against the end portions 32 of legs 30 and the legs again come to biased seating engagement with the pockets of lips 28 of bracket 24 and the ground engagement means assumes its first operative ground engaging position. To dispose the ground engagement means from its ground engaging position to its inoperative position the sequence of operations described above is reversed. The end portions 32 of legs 30 thus serve as actuating means for rendering the ground engagement means 40 operative and inoperative. As noted above, the end portions 32 of legs 30 are preferably provided with enlarged cushion members 36. Cushion members 36 enhance the user's comfort and safety when operating the actuating means 32.

According to a presently preferred working embodiment represented in the drawings, the total weight of walking aid stabilizing apparatus 10 is about 4 ounces and the lateral force required to operate actuating means 32 is about three pounds. Such low total weight and low actuating force render the device unburdensome to all but the most physically challenged users. However, alternative embodiments of the invention are contemplated that can reduce the overall weight of the device and eliminate the need to exert other than negligible force and dexterity to dispose ground engagement means 40 between its first and second positions.

For example, in lieu of ground engagement means support member 26 being configured to have a pair of spaced apart legs inwardly biased by a bracket 24, the ground engagement means support member may comprise one or more unbiased legs having end(s) pivotally connected to fastening means 12. In these circumstances, ground engagement means support member 26 may carry lightweight and easily releasable retaining means such as a reversible clasp, a reversible lightly biased C-shaped spring clamp, or a double-sided hook and loop type (e.g., VELCRO®) strap or other belt-type fastening means of sufficient dimensions to capture the walking aid 14. With such a construction, the user can release the retaining means from the walking aid 14, pivot the ground engagement means support member 26 upwardly or downwardly, as the case may be, and then reconnect the retaining means to the walking aid to secure the ground engagement means 40 into the desired operative or inoperative position. Alternatively, the ground engagement means support member 26 may comprise at least one threaded rod that is threadedly received within correspondingly threaded member(s) carried by fastening means 12. In this way, the user can simply raise or lower the ground engagement means into the inoperative and operative positions by rotating the threaded rod(s) in one direction or the other. The threaded rod(s) should be rotatably connected to the ground engagement means 40 so that they may rotate freely with respect to the ground engagement means. For single threaded rod embodiments, the rotatable connection between the threaded rod and the ground engagement means would permit the user to manually align the peripheral notch 60 to accommodate the walking aid 14 when placing the ground engagement means into its inoperative position.

Although the invention has been described in detail for the purpose of illustration, it is to be understood that such detail is solely for that purpose and that variations can be made therein by those skilled in the art without departing from the spirit and scope of the invention as claimed herein.

What is claimed is:

1. A stabilizing apparatus for use with a walking aid having a ground contacting area at a bottom thereof, said apparatus comprising:

ground engagement means for contacting a ground surface, said ground engagement means comprising a plurality of perforated areas and having a substantially larger peripheral area than the ground contacting area at the bottom of a walking aid;

means for fastening said apparatus to a walking aid, said fastening means being mountable entirely exteriorly of a walking aid; and means connected to said ground engagement means and said fastening means for disposing said ground engagement means into a first operative ground engaging position and a second inoperative position.

2. The apparatus of claim 1 wherein said ground engagement means comprises a notch for accommodating a walking aid when said ground engagement means is in said second position.

3. The apparatus of claim 1 further comprising means for releasably retaining said ground engagement means in said first and second positions.

4. A stabilizing apparatus for use with a walking aid having a ground contacting area at a bottom thereof, said apparatus comprising:

ground engagement means for contacting a ground surface, said ground engagement means having a substantially larger peripheral area than the ground contacting area at the bottom of a walking aid;

means for fastening said apparatus to a walking aid, said fastening means being mountable entirely exteriorly of a walking aid; and a pair of spaced apart legs pivotally connected to and in biased contact with said fastening means and connected to said ground engagement means for disposing said ground engagement means into a first operative ground engaging position and a second inoperative position.

5. The apparatus of claim 4 wherein said legs comprise oppositely directed end portions that function as actuating means for enabling selective release of said legs from biased contact with said fastening means and disposition of said ground engagement means between said first and second positions.

6. The apparatus of claim 5 wherein said fastening means comprise a bracket having a pair of opposed inwardly directed lips that define opposed pockets for receiving and biasing said legs.

7. The apparatus of claim 4 wherein said ground engagement means comprise a plurality of perforated areas.

8. The apparatus of claim 4 further comprising means for releasably retaining said ground engagement means in said first and second positions.

9. The apparatus of claim 4 wherein said ground engagement means has a concave elevational profile.

10. The apparatus of claim 4 wherein said ground engagement means comprises a notch for accommodating a walking aid when said ground engagement means is in said second position.

11. A stabilizing apparatus for use with a walking aid having a ground contacting area at a bottom thereof, said apparatus comprising:

ground engagement means for contacting a ground surface, said ground engagement means having a concave elevational profile and a substantially larger peripheral area than the ground contacting area at the bottom of a walking aid;

means for fastening said apparatus to a walking aid, said fastening means being mountable entirely exteriorly of a walking aid; and means connected to said ground engagement means and said fastening means for disposing said ground engagement means into a first operative ground engaging position and a second inoperative position.

12. The apparatus of claim 11 wherein said means connected to said ground engagement means and said fastening means comprises a pair of spaced apart legs pivotally connected to and in biased contact with said fastening means.

13. The apparatus of claim 12 wherein said legs comprise oppositely directed end portions that function as actuating means for enabling selective release of said legs from biased contact with said fastening means and disposition of said ground engagement means between said first and second positions.

14. The apparatus of claim 13 wherein said fastening means comprise a bracket having a pair of opposed inwardly directed lips that define opposed pockets for receiving and biasing said legs.

15. The apparatus of claim 11 wherein said ground engagement means comprise a plurality of perforated areas.

16. The apparatus of claim 11 further comprising means for releasably retaining said ground engagement means in said first and second positions.

17. The apparatus of claim 11 wherein said ground engagement means comprises a notch for accommodating a walking aid when said ground engagement means is in said second position.

* * * * *